US007669561B2

(12) United States Patent
Ramella

(10) Patent No.: US 7,669,561 B2
(45) Date of Patent: Mar. 2, 2010

(54) HIGH-OUTPUT TWO-STROKE ENGINE IN PARTICULAR FOR APPLICATION IN MODEL ASSEMBLY

(75) Inventor: Fabrice Ramella, Vufflens-la-Ville (CH)

(73) Assignee: Team Orion Europe SA, Plan-les-Ouates (CH)

( * ) Notice: Subject to any disclaimer, the term of this patent is extended or adjusted under 35 U.S.C. 154(b) by 95 days.

(21) Appl. No.: 11/659,378

(22) PCT Filed: Jul. 6, 2005

(86) PCT No.: PCT/CH2005/000381

§ 371 (c)(1),
(2), (4) Date: Oct. 9, 2007

(87) PCT Pub. No.: WO2006/012757

PCT Pub. Date: Feb. 9, 2006

(65) Prior Publication Data

US 2008/0163856 A1 Jul. 10, 2008

(30) Foreign Application Priority Data

Aug. 6, 2004 (CH) ..... 1318/04

(51) Int. Cl.
*F02B 25/00* (2006.01)
*F02B 33/00* (2006.01)

(52) U.S. Cl. ..... 123/65 R; 123/73 R; 123/73 A

(58) Field of Classification Search ..... 123/65 R, 123/73 R, 73 A, 73 DA, 73 V
See application file for complete search history.

(56) References Cited

U.S. PATENT DOCUMENTS

| | | | | |
|---|---|---|---|---|
| 1,109,192 | A * | 9/1914 | Wright | 123/73 DA |
| 2,565,972 | A * | 8/1951 | Kos | 123/73 DA |
| 4,054,115 | A | 10/1977 | v. Habsburg-Lothringen | |
| 2004/0079303 | A1 | 4/2004 | Saad et al. | |

FOREIGN PATENT DOCUMENTS

| | | | |
|---|---|---|---|
| GB | 593551 | A | 10/1947 |
| GB | 628593 | A | 8/1949 |
| GB | 2 195 396 | A | 4/1988 |

* cited by examiner

*Primary Examiner*—Noah Kamen
(74) *Attorney, Agent, or Firm*—The Webb Law Firm

(57) ABSTRACT

A two-stroke engine has a piston, mounted to be displaced in a cylinder, connected by means of a connecting rod to a crankshaft mounted to rotate about an axis in a crankcase that defines a crankcase chamber. The crankshaft includes a crankshaft duct that opens into the crankcase chamber which is, depending on the angle of rotation of the crankshaft, connected by way of an inlet opening in the crankshaft to an inlet manifold for an air/fuel mixture. The cylinder includes a transfer port, by way of which, the air/fuel mixture flows from the crankcase chamber past the piston into the working chamber based on the position of the piston in the cylinder. An increase in engine power is achieved by a gas mixing duct, a slot or a deflecting element arranged within the crankcase which improve(s) the filling of the crankcase chamber with the air/fuel mixture.

10 Claims, 12 Drawing Sheets

18
33
34
35
36
37
38
39
40
41
42

37
40
45
39
18
20
44
40
36
16
38
15
45
37
11
18
42

40
37'
45
39
48
20
36
40
44
16
45
38
37'
15
11
48
42

HIGH-OUTPUT TWO-STROKE ENGINE IN PARTICULAR FOR APPLICATION IN MODEL ASSEMBLY

BACKGROUND OF THE INVENTION

1. Field of the Invention

The present invention relates to internal combustion engines and, more particularly, to a high-power two-stroke engine for use in model construction.

2. Description of Related Art

Compact high-power two-stroke engines (for example "nitro engines" with a carburetor and glow plugs, or gasoline engines with spark plugs), which output power levels of up to several PS (for example 2.6 PS) at speeds of up to 40,000 rpm, are used primarily in applications with space and/or weight restrictions, for example in go-karts, ultra-light motorized aircraft (ULM), microlight aircraft (Micro Air Vehicles MAV) and the like. They have in particular for a long time proven themselves, in addition to electrical high-power drives, for driving model aircraft, model boats and model cars, specifically in the demanding hobby field and for racing applications.

The exemplary construction of a high-power two-stroke engine having one cylinder is shown in an exploded illustration in FIG. 1*a*. The carburetor has been omitted here for clarity. The high-power two-stroke engine 10 comprises a crankcase 11 having an integrally formed cylinder 12 which has cooling fins. A crankshaft 18 is rotatably mounted in the crankcase 11, so as to lie horizontal, by means of two ball bearings 14 and 16. Non-ferrous metal plain bearings could also be used instead of the ball bearings 14, 16 for mounting the crankshaft 18. The crankshaft 18 projects out of the crankcase 11 through the front ball bearing 14 and is secured, for example, by means of a conical driver 13. Power is taken from the projecting end of the crankshaft 18. At the rear side, the crankcase 11 is closed off by means of a cover 20 which is screwed by means of screws 21 to the crankcase 11 and closes off the latter in a gas-tight manner with the aid of an interposed seal 19. The crankshaft 18 supports, at the rear, circular-disk-shaped end (section 36 in FIG. 2*a*), an eccentrically arranged crank pin 40 on which a connecting rod 22 is rotatably seated with its lower end. Formed opposite the crank pin 40 is a counterweight 39. The upper end of the connecting rod 22 is rotatably connected, by means of a piston pin 26 which is secured by means of securing rings 23, to a piston 24 which can move in a reciprocating fashion so as to slide in a vertical running sleeve 25 which is inserted in the cylinder 12. The upwardly open cylinder 12 is closed off by means of a head plate 28 which, in the centre, has a threaded bore for screwing in a glow plug 30. The head plate 28 is fastened to the cylinder 12 by means of a cooling head 29 which sits on top of said head plate 28 and is screwed by means of screws 31 to the cylinder 12 through a crown of vertical bores (or to the crankcase 11 through the cylinder). In order to adjust the spacing of the head plate 28 from the running sleeve 25 and therefore to adjust the working space, annular adjusting plates of a predetermined thickness are arranged between the running sleeve 25 and the head plate.

In the high-power two-stroke engine 10 of the type illustrated in FIG. 1*a*, the intake of the air/fuel mixture and the discharge of the combustion gases are controlled in a manner known per se by means of the piston 24 which runs in the running sleeve 25 (and by means of the crankshaft 18). During an upward movement of the piston 24, a vacuum is generated in the space which is situated below the piston 24 and is connected to the crank space (44 in FIG. 4) of the crankcase

11, which vacuum sucks air/fuel mixture via an intake pipe 15 on the crankcase 11 from the carburetor which is attached there. As the piston 24 moves downward again after passing through top dead center TDC and an ignition, it firstly opens an exhaust gas outlet opening 17 which is arranged laterally on the cylinder 12 and via which the combustion gases are discharged. The connection between the intake pipe 15 and the crank space 44 of the crankcase 11 is interrupted, and the air/fuel mixture situated in the interior 44 is then pushed via transfer ducts 32*a*-32*c* in FIG. 1*b*), which are arranged laterally in the cylinder wall, into the working space, which is freed up by the piston 24, above the piston 24, where it pushes out the combustion gases (charge exchange). During the renewed downward movement of the piston 24, the mixture is compressed and ignited after passing through TDC. The further details of said two-stroke process are familiar to a person skilled in the art and are therefore not discussed in any more detail here.

It is pointed out at this stage that, in the two-stroke high-power engine 10 illustrated in FIG. 1*a*, the exhaust gas outlet opening 17 is arranged directly opposite the intake pipe 15, and that in FIG. 1*b*, a total of three equivalent transfer ducts 32*a*-32*c* are provided which, in relation to the exhaust gas outlet opening 17, are arranged offset with respect to the cylinder axis by 90°, 180° and 270°. The transfer ducts 32*a*-32*c* are generated by the interaction of recesses in the cylinder wall with the running sleeve 25 (FIG. 1*a*) which is inserted in the cylinder 12. The arrangement of the three transfer ducts 32*a*-32*c* corresponds to a highly effective combined transverse-flow/reverse-flow scavenging arrangement, as described in EP-A1-0 059 872. Correspondingly, 4 horizontal slots are provided in the running sleeve 25—as can be seen in FIG. l*a*—which slots are arranged offset relative to one another by 90° in each case. The one slot assigned to the exhaust gas outlet opening 17 is situated here at a different level than the three other transfer slots.

The intake of the gas/fuel mixture, as is known per se, via the crankshaft 18 and its control by means of the crankshaft 18 (in this regard, see for example DE-U1-295 11 007) results from the design of the crankshaft 18 as per FIGS. 2*a*, 2*b*, 3*a* and 3*b* and its interaction with the crankcase 11 as per FIGS. 4 and 5. The crankshaft 18 is divided along the axis 42 into several sections 33, . . . , 36 of different outer diameter. The frontmost section 33 projects out of the crankcase 11 and serves for the take-off of engine power. The crankshaft 18 is mounted with the next section 34 in the front ball bearing 14. The thread 41 arranged between the two sections 33 and 34 serves to fasten parts to the crankshaft 18. The section 34 is adjoined by a further cylindrical section 35 whose outer diameter is considerably greater. The crankshaft 18 lies, as per FIGS. 4 and 5, with the section 35 in a matched bore in the crankcase 11 into which the intake pipe 15 opens out. In the section 35, the crankshaft 18 has, formed from the rear end, a coaxial blind hole which forms a crankshaft duct or gas mixing duct 37. At the level at which the intake pipe 15 opens out, an inlet opening 38 in the wall of the section 35 is exposed which, in a certain rotational position of the crankshaft 18 (FIG. 5) connects the crankshaft duct 37 to the intake pipe 15 with the maximum cross section, but in the other rotational positions, largely blocks the connection (FIG. 4). The crankshaft 18 which is designed in this way forms a valve which is synchronized with the piston movement and which, over a predefined angular range of each rotation, permits the intake of air/fuel mixture from the carburetor via the crankshaft duct 37 and into the crank space 44.

As already described further above, the upward-traveling piston 24 generates a vacuum in the crank space 44, which vacuum, when the inlet opening 38 of the crankshaft 18 rotates into the region of the intake pipe 15, leads to an intake of the air/fuel mixture formed in the carburetor. The intake mixture flows in the axial direction through the crankshaft duct 37, then passes out into the crank space 44 and impinges on the opposite wall of the crankcase cover 20, is pre-compressed as the piston 24 moves downward and is then pushed out of the crank space via the lateral transfer ducts 32*a*-32*c* into the working space situated above the piston 24.

There are however various disadvantages in the described process. As indicated by the arrows and double arrows in FIG. 5, the mixture passing out of the crankshaft duct 37 impinges perpendicularly on the opposite wall of the cover 20, then rebounds in the opposite direction and thereby hinders the subsequent gas flow out of the shaft duct 37. This leads to a reduction of the mixture quantity available per working cycle and therefore to a degradation in engine power. The mixture flow which is aligned axially into the crank space 44 also has the disadvantage that the mixture, which simultaneously also serves to provide lubrication, only passes to a limited extent into the region of the rear ball bearing 16, so that the lubrication of the latter is not optimal. Finally, fundamentally only insufficient filling of the working space can be obtained with the mixture transport based exclusively on the piston movement.

It has been proposed in DE-A1-29 33 796 to provide, in a two-stroke model construction engine which has a plurality of cylinders (in a V-arrangement or star arrangement) and whose crankshaft is mounted on the crank cheeks, a rotary slide valve which allows the mixture to flow through to the cylinders in succession and has an axially aligned inflow and a radially orientated outflow. The rotary slide valve can, by means of the radially aligned outflow, control different ducts in the crankcase which are assigned to the different cylinders. The rotary slide valve is formed at the rear end of the crankshaft. The gas/fuel mixture is supplied to the rotary slide valve via a duct which runs in the axle and in which a throttle flap is arranged. The radial outflow of the air/fuel mixture out of the rotary slide valve is intended to generate a charging effect. Said known solution is designed for multi-cylinder engines. The solution cannot be used for conventional single-cylinder engines in which the carburetor and intake pipe are situated on the front side above the driveshaft and in which a starter device is in some cases installed on the rear side.

US-A1-2004/0079303 proposes the use, for small two-stroke engines which are charged with the air/fuel mixture via the crankcase, of a nozzle/diffuser combination ("nozzle diffuser") which is arranged in the crankshaft axle. The nozzle diffuser is intended to have two effects: on the one hand, it should increase the turbulence of the mixture flow and thereby provide improved mixture and combustion. On the other hand, it should increase the speed and compression of the mixture and thereby provide a type of turbocharger effect which increases the power of the engine. In addition, radial ducts which lead outward from the nozzle diffuser can be provided in a counterweight. Said ducts are alleged to make the power of the engine more uniform. An increased improvement in power and a reduction in fuel consumption were observed when using a nozzle on its own and when using a nozzle/diffuser combination. A disadvantage of said solution, however, is that the narrowed cross section of the nozzle increases the flow resistance of the mixture between the carburetor and the crank space and therefore counteracts the suction action provided exclusively by the piston.

SUMMARY OF THE INVENTION

The invention is a high-power two-stroke engine for applications which are restricted in space and/or weight terms, in particular for use in model construction.

The invention includes means within the crankcase for improving the flow of the air/fuel mixture flowing into the crank space in such a way as to improve the filling of the crank space with the air/fuel mixture per working cycle.

According to a first embodiment of the invention, the means for improving the flow of the air/fuel mixture includes a crankshaft duct which runs within the crankshaft in such a way that centrifugal forces occurring as the crankshaft rotates accelerate the air/fuel mixture flowing in the crankshaft duct in the direction of the crank space. The crankshaft duct ensures that the crankshaft acts as a stand-alone pump which conveys the mixture into the crank space in addition to the vacuum generated by the piston and thereby improves the filling of the crank space. The acceleration of the mixture in the crankshaft duct is dependent not only on the radial spacing to the crankshaft axis but also on the angular speed or rotational speed of the engine. The higher the rotational speed of the engine, the greater the propulsive forces exerted on the mixture.

The crankshaft duct is desirably formed as a bore and encloses an angle $\alpha>0°$ with the axis of the crankshaft. For a given angle, maximum acceleration is achieved if the crankshaft duct runs within the crankshaft in such a way that the spacing between the axis of the crankshaft duct and the axis of the crankshaft increases with reducing distance from the crank space. The bore, of the crankshaft duct, which is aligned obliquely to the crankshaft axis, causes the mixture passing out of the duct into the crank space to impinge on the opposite wall of the crankcase cover at an oblique angle, whereupon a flow-hindering rebound is avoided.

With regard to the entry of the mixture into the transfer ducts arranged in the side of the crankshaft, it is desirable if, in a high-power two-stroke engine in which the connecting rod is connected to the crankshaft by means of an eccentrically arranged crank pin, the crankshaft duct opens out into the crank space at the side opposite from the crank pin.

A further improvement in the charging of engines with an obliquely-running crankshaft duct can include a connection which runs in the radial direction between the crankshaft duct and the crank space, through which connection the mixture is centrifuged out of the crankshaft in the radial direction. This connection is desirably arranged on the side opposite from the crank pin and is desirably formed as a slot.

If the crankshaft has, in the region of the crank space, a disk-shaped section which is perpendicular to the axis and to which the crank pin is fastened, and the crankshaft is rotatably mounted, at that side of the disk-shaped section which faces away from the crank space, in a bearing, it is desirable for the required lubrication of the bearing at the very high rotational speeds for the connection or the slot to be arranged in the disk-shaped section, and for the connection or the slot to be formed such that air/fuel mixture situated in the crankshaft duct passes through the connection directly to the bearing.

Even in the case of a conventional coaxial crankshaft duct, the charging of the engine can be improved if the means for improving the flow of the air fuel mixture can include a connection which runs in the crankshaft in the radial direction between the crankshaft duct and the crank space. As a result of the radial connection, a part of the mixture is accelerated and centrifuged out of the crankshaft into the crank space.

This is in turn particularly favorable with regard to laterally arranged transfer ducts if, in high-power two-stroke engines in which the connecting rod is connected to the crankshaft by means of an eccentrically arranged crank pin, the connection is arranged at the side opposite from the crank pin.

It is also possible, if the crankshaft has, in the region of the crank space, a disk-shaped section which is perpendicular to the axis and to which the crank pin is fastened, and if the crankshaft is rotatably mounted, at that side of the disk-shaped section which faces away from the crank space, in a bearing, to lubricate the bearing more effectively in that the connection is arranged at least partially in the disk-shaped section, and in that the connection is formed such that air/fuel mixture situated in the crankshaft duct passes through the connection directly to the bearing.

The connection can be formed as a slot. However, it can also be formed as a duct.

Finally, if the crank space is delimited, at the side opposite from the aperture of the crankshaft duct, by a wall which is aligned perpendicular to the crankshaft duct, the means for improving flow of the air fuel mixture the can include deflecting means which are arranged in the wall and which deflect the flow of air/fuel mixture, which passes out of the crankshaft duct and impinges perpendicularly on the wall, to the side. The deflecting means can include a deflecting cone.

BRIEF DESCRIPTION OF THE DRAWINGS

The invention is to be explained in more detail in the following on the basis of exemplary embodiments in connection with the drawings, in which.

DETAILED DESCRIPTION OF THE INVENTION

Figure 6:
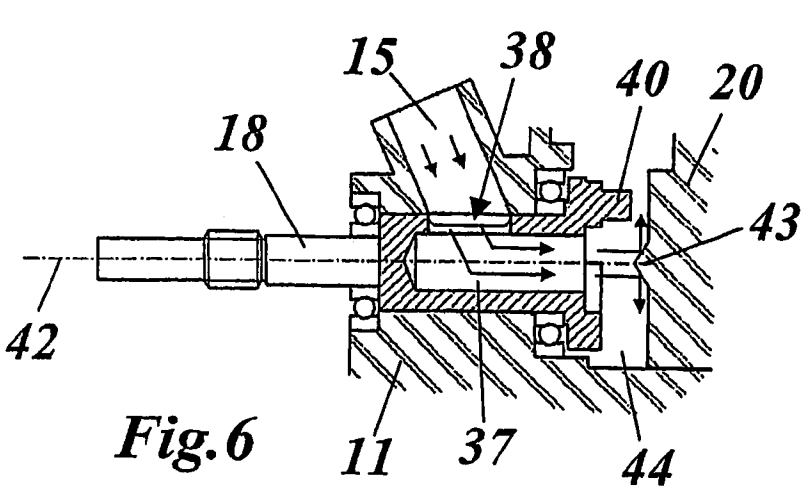
FIG. 6 shows, in an illustration similar to FIG. 4, a crankcase in which, according to one exemplary embodiment of the invention, the direct rebound of the mixture flow is prevented by a conical deflecting element on the wall of the cover.

FIG. 6 illustrates a first exemplary embodiment for an engine according to the invention. The crankshaft 18 is of a design known per se, as shown in FIGS. 2 to 5. Said crankshaft 18 has a coaxial crankshaft duct 37 which is in a certain rotational position connected by means of the inlet opening 38 to the intake pipe 15 and opens out at the other end into the crank space 44 of the crankcase 11. The crankshaft duct 37 has an inner diameter of several millimeters, for example 7 mm. The aperture of the crankshaft duct 37 is situated—in engines without a starting device—with a spacing of a few millimeters opposite the perpendicular wall of the cover 20 which closes off the crankcase 11 in a gas-tight manner at the rear side. Arranged in the wall directly opposite the aperture is a deflecting element in the form of a deflecting cone 43. The deflecting cone 43 is aligned with the tip in the direction of the aperture of the crankshaft duct 37. The level and the cone angle of the deflecting cone 43 are selected such that, on the one hand, the cone does not impede the connecting rod which moves in the crank space 44 (this can be aided by means of a special design of the connecting rod), and on the other hand, the mixture flowing through the crankshaft duct 37 and impinging on the deflecting cone 43 is deflected to the side, as indicated in FIG. 6 by the arrows. The deflecting cone 43 thereby prevents the mixture from rebounding from the wall of the cover 20 in the same direction, which is detrimental to the charging, and at the same time promotes the further mixture of the air/fuel mixture formed in the carburetor. In this embodiment, however, the mixture continues to be conveyed only by the vacuum generated by the piston.

Figure 7:
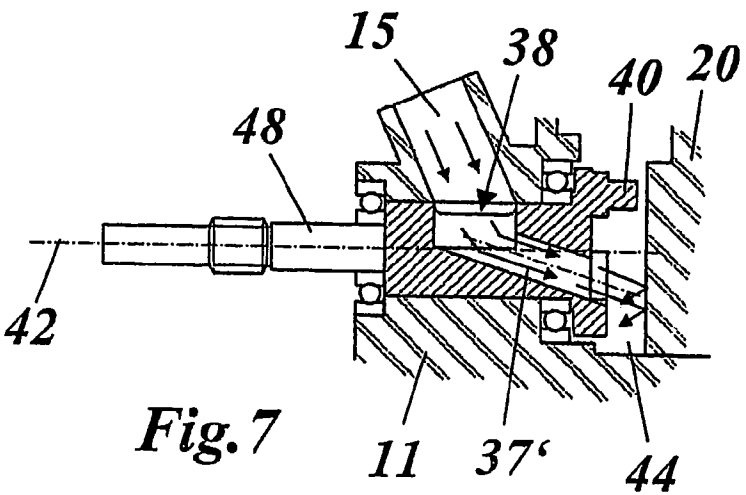
FIG. 7 shows, in an illustration similar to FIG. 4, a crankshaft with an oblique crankshaft duct, as per another exemplary embodiment of the invention.
Figure 4:
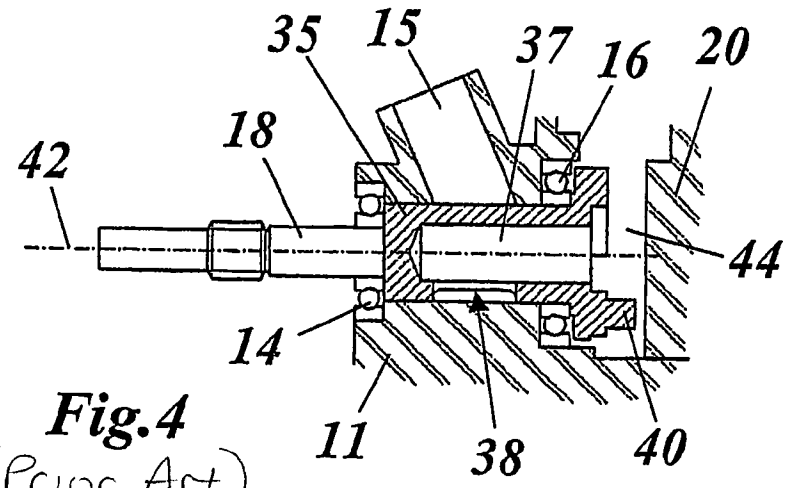
Fig.4 (Prior Art)
FIG. 4 shows, in a simplified illustration, the situation of the crankshaft from FIG. 3*a* in the crankcase in a rotational position in which the connection between the crankshaft duct and the intake pipe is blocked.
Figure 11:
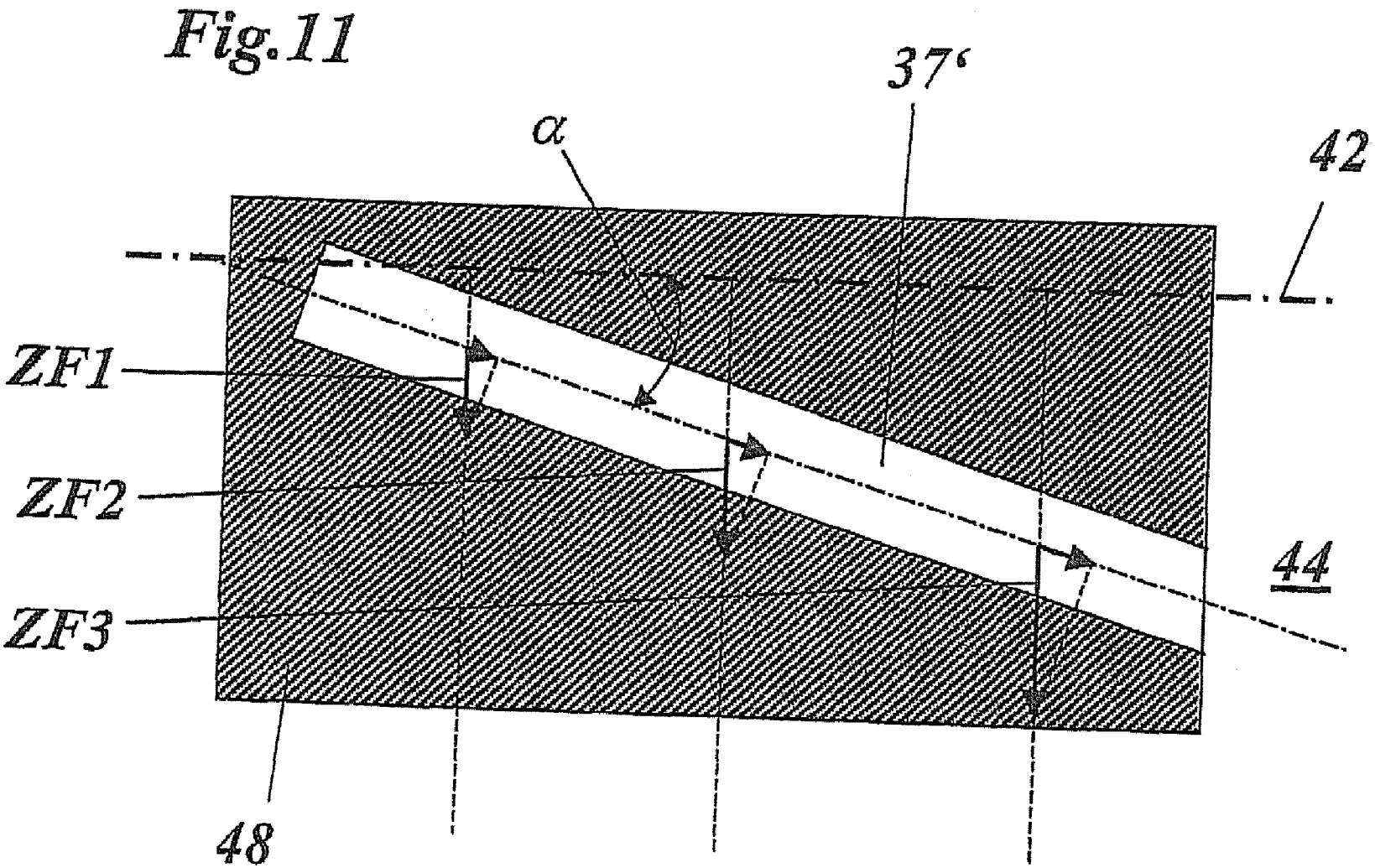
FIG. 11 shows, in a detail of the crankshaft, a schematic illustration of an oblique crankshaft duct in order to illustrate the centrifugal acceleration forces.

In order to generate an additional pumping action and to thereby actively improve the charging of the crank space 44 with the mixture, a configuration of the crankshaft as per FIG. 7 is particularly advantageous. In the crankshaft 48 of FIG. 7, the crankshaft duct 37', which leads from the inlet opening 38 to the crank space 44 and is formed as a bore, is aligned obliquely relative to the axis 42. Said crankshaft duct 37', according to the schematic illustration of FIG. 11, encloses an angle $\alpha>0$, for example of 20° with the axis 42. At the same time, the crankshaft duct 37' is situated to one side of the axis 42, so that the radial spacing between the axis 42 of the crankshaft 48 and the axis of the crankshaft duct 37' increases with decreasing distance to the crank space 44. As the crankshaft 48 rotates about the axis 42, the mixture situated in the crankshaft duct 37' is subjected to a centrifugal force ZF which increases with the rotational speed and with the radial spacing of the two axes. FIG. 11 shows the centrifugal forces ZF1, . . . , ZF3 associated with three different distances to the crank space 44, and therefore with three different spacings of the axes, as radial vectors. The components of said vectors in the direction of the axis of the crankshaft duct 37' represent the increasing acceleration forces for the mixture flowing in the duct as it approaches the crank space 44. The acceleration at each point is greater, the greater the selected angle $\alpha$, and reaches its theoretical maximum at $\alpha=90°$. A limit is however provided by the predefined outer geometry of the crankshaft 48 and the position of the intake pipe 15.

Figure 1A:
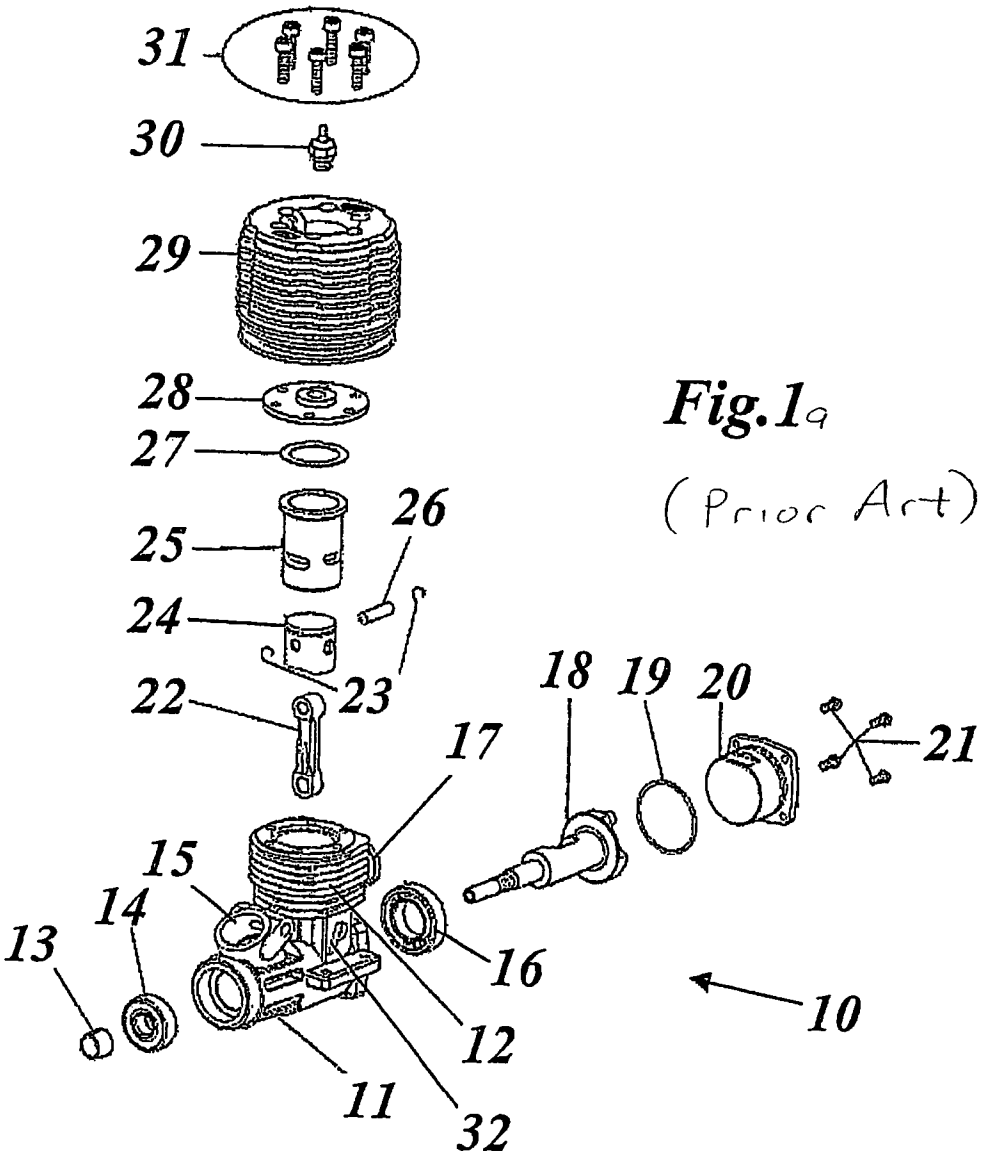
Fig. 1a (Prior Art)
FIG. 1*a* shows, in an exploded illustration, the parts of a known (single-cylinder) high-power two-stroke engine as is suitable for implementing the invention.
Figure 1B:
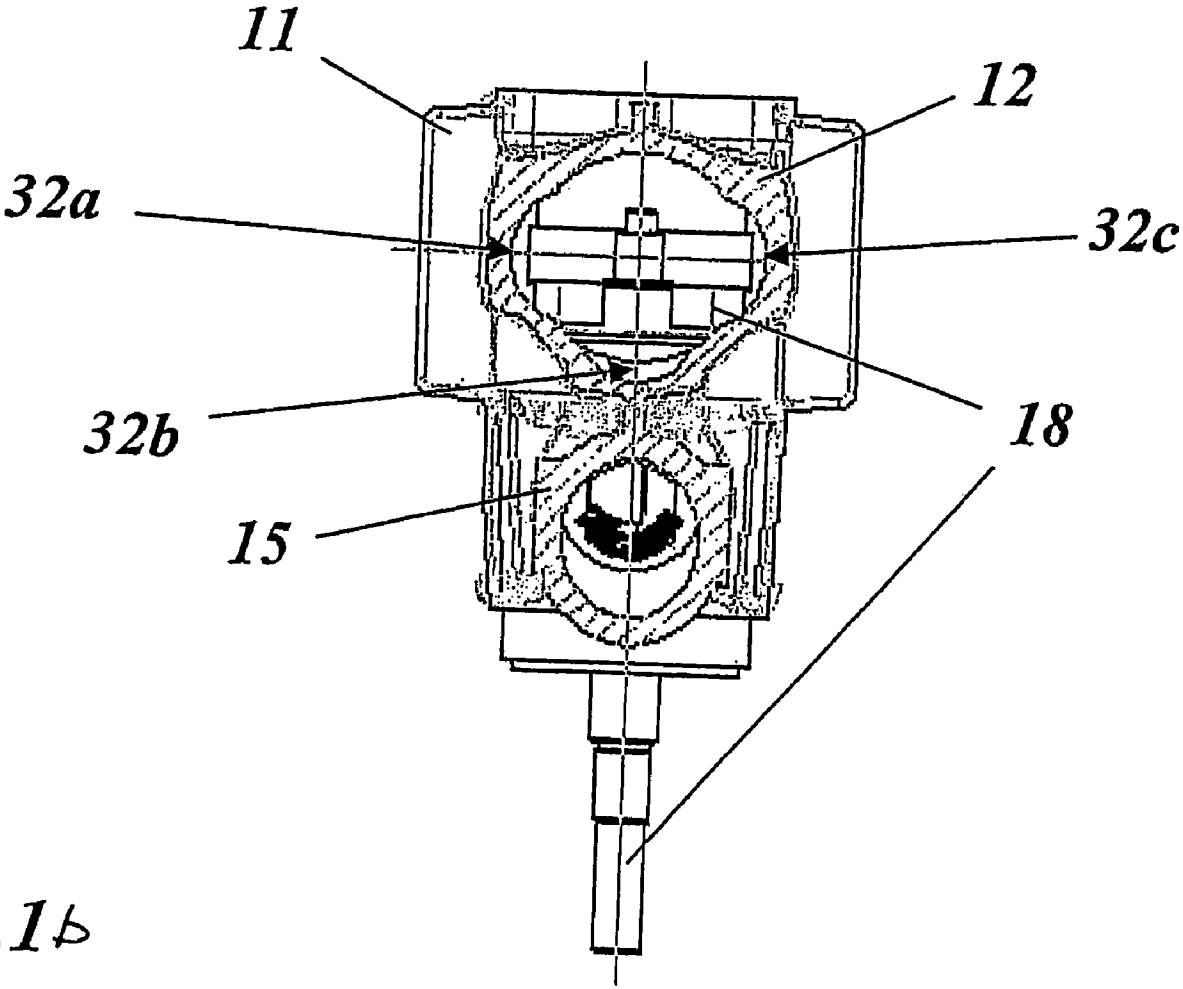
Fig. 1b (Prior Art)
FIG. 1*b* shows, in a plan view from above, a cross-section through the cylinder and the crankcase with the crankshaft inserted therein, of a high-power two-stroke engine of FIG. 1*a;*
Figures 2A, 2B, 3A, 3B:
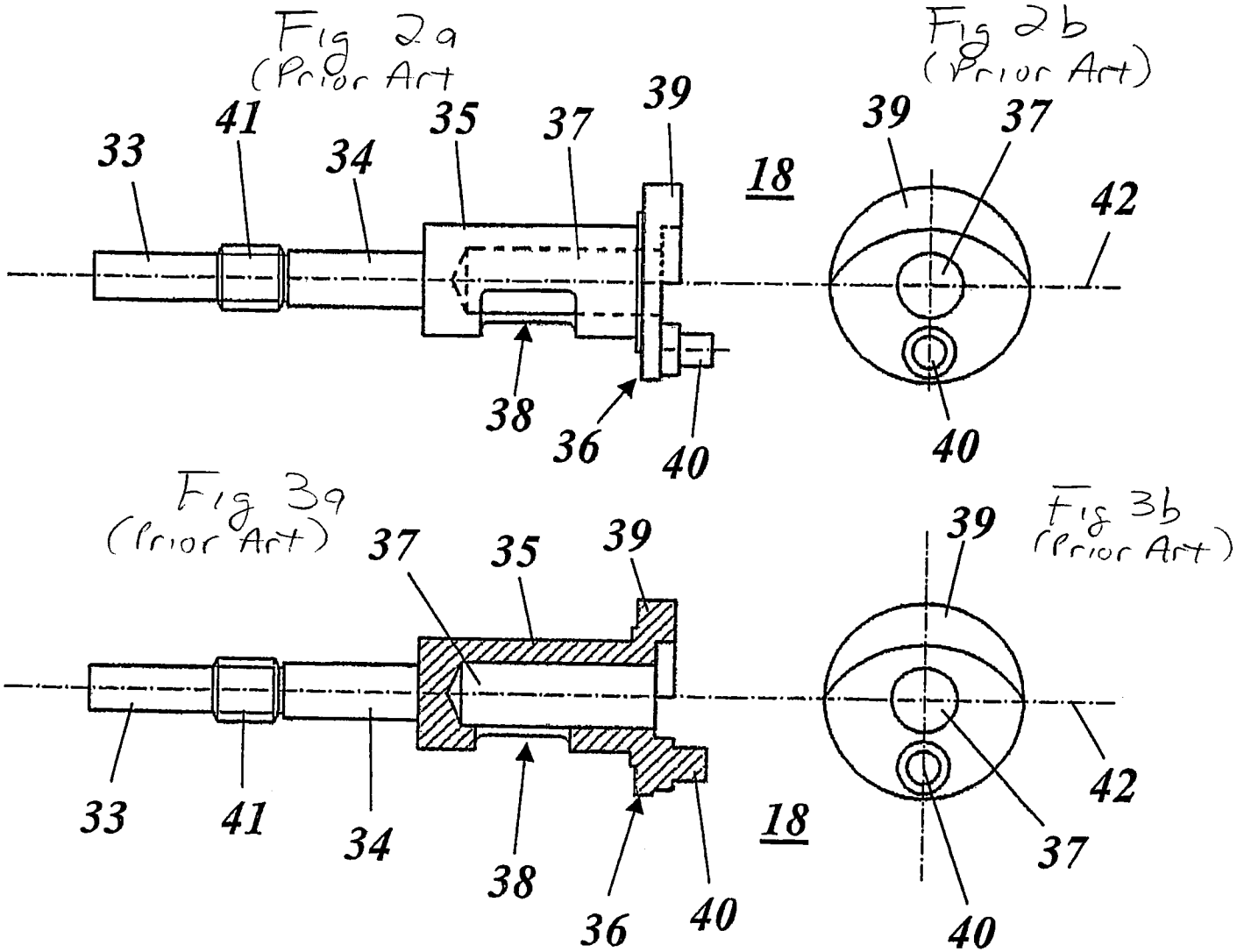
Fig 2a (Prior Art)
Fig 2b (Prior Art)
Fig 3a (Prior Art)
Fig 3b (Prior Art)
FIGS. 2*a* and 2*b* show, in a side view and in a view from the rear respectively, the crankshaft of the engine of FIG. 1*a;*
FIGS. 3*a* and 3*b* show the partially sectioned crankshaft from FIGS. 2*a* and 2b in an illustration similar to FIGS. 2*a* and 2*b;*
Figure 5:
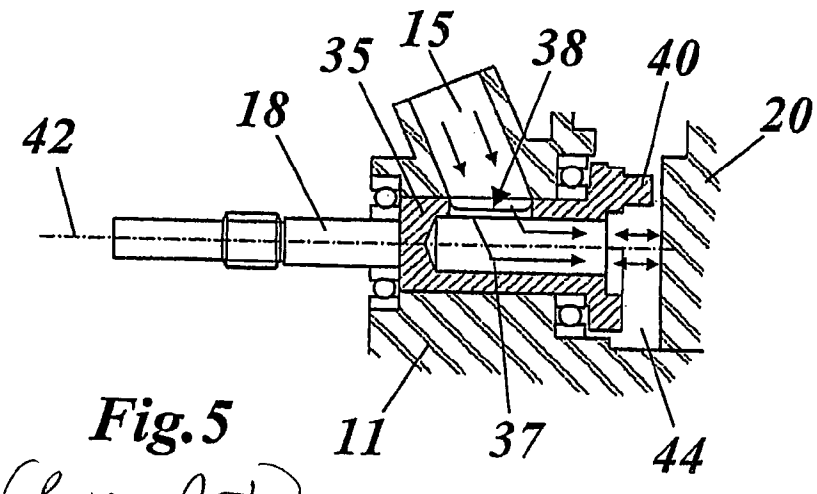
Fig.5 (Prior Art)
FIG. 5 shows the arrangement from FIG. 4 in a rotational position of the crankshaft in which the connection is produced between the crankshaft duct and the intake pipe.

As a result of the oblique alignment of the crankshaft duct 37', the crankshaft 48 of FIG. 7 acts as a centrifugal pump. Said pump serves to convey the air/fuel mixture through the crankshaft duct 37' into the crank space 44. More mixture is therefore stored in the crankshaft case 11, so that more mixture is also available for the combustion in the working space. This increases the power of the engine. The obliquely-running crankshaft duct however has a further effect: as a result of the oblique alignment, the mixture—as indicated in FIG. 7 by the arrows—impinges not perpendicularly but obliquely against the wall of the cover 20, so that the hindrance of the flow, as indicated in FIG. 5, as it rebounds in the same direction is avoided. A further effect is obtained in that the aperture of the crankshaft duct 37' shown in FIG. 7 is situated at that side of the disk-shaped section 36 of the crankshaft 48 which is situated opposite from the crank pin 40. If, as indicated in FIG. 1*b* by the reference symbols 32*a*-32*c*, transfer ducts are provided in the wall of the cylinder 12 laterally with respect to the crankshaft 18 or 48 (see transfer ducts 32*a*-32*c* in FIG. 1*b*), then as a result of the eccentrically situated aperture of the crankshaft duct 37', the mixture is centrifuged directly into at least one of the lateral transfer ducts 32*a*-32*c*, thereby further promoting the charging process.

Figures 8A, 8B:
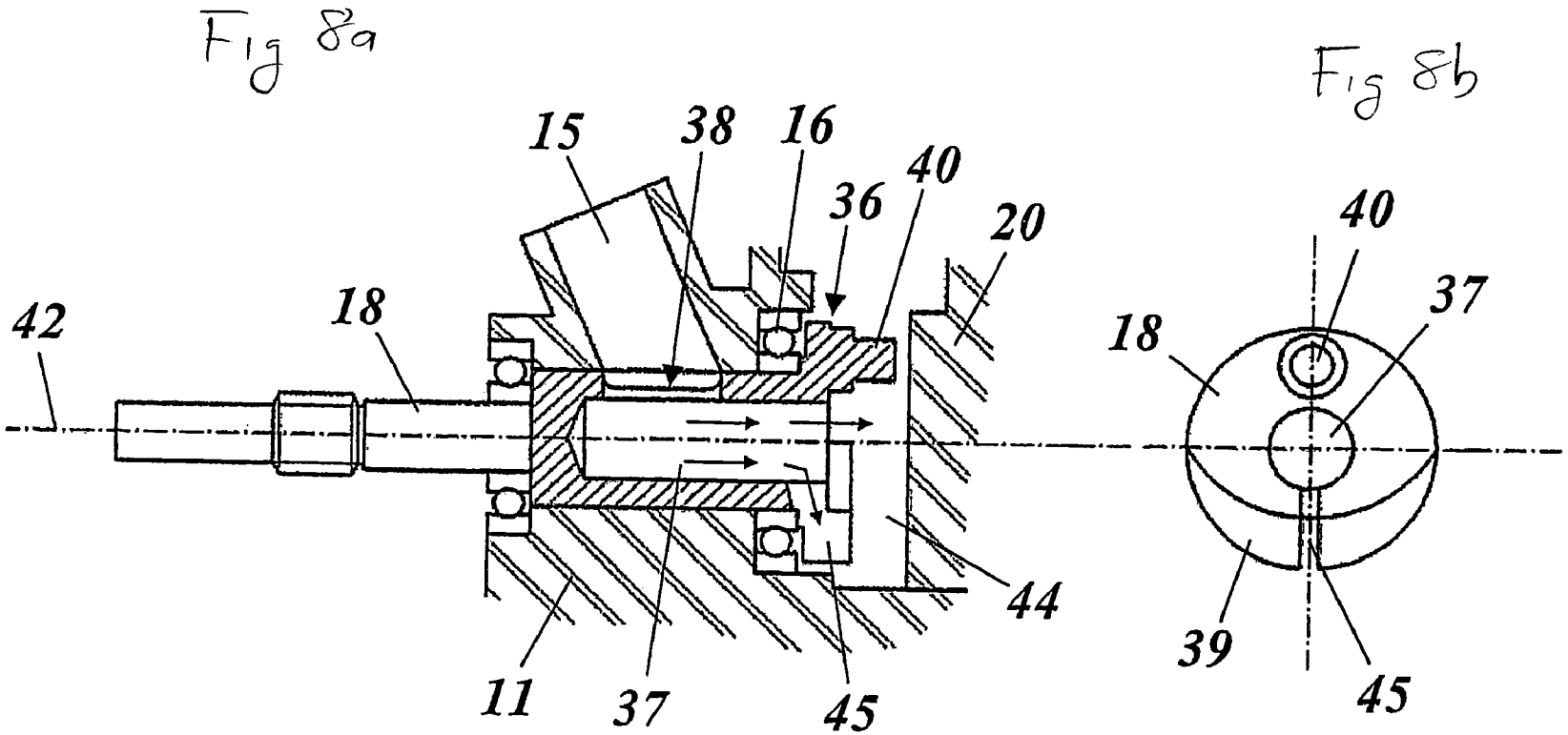
FIGS. 8*a* and 8*b* show, in a partially sectioned side view and in a plan view from the rear, respectively, a crankshaft as per a further exemplary embodiment of the invention with a radial opening in the form of a slot at the aperture of the crankshaft duct.
Figures 9A, 9B:
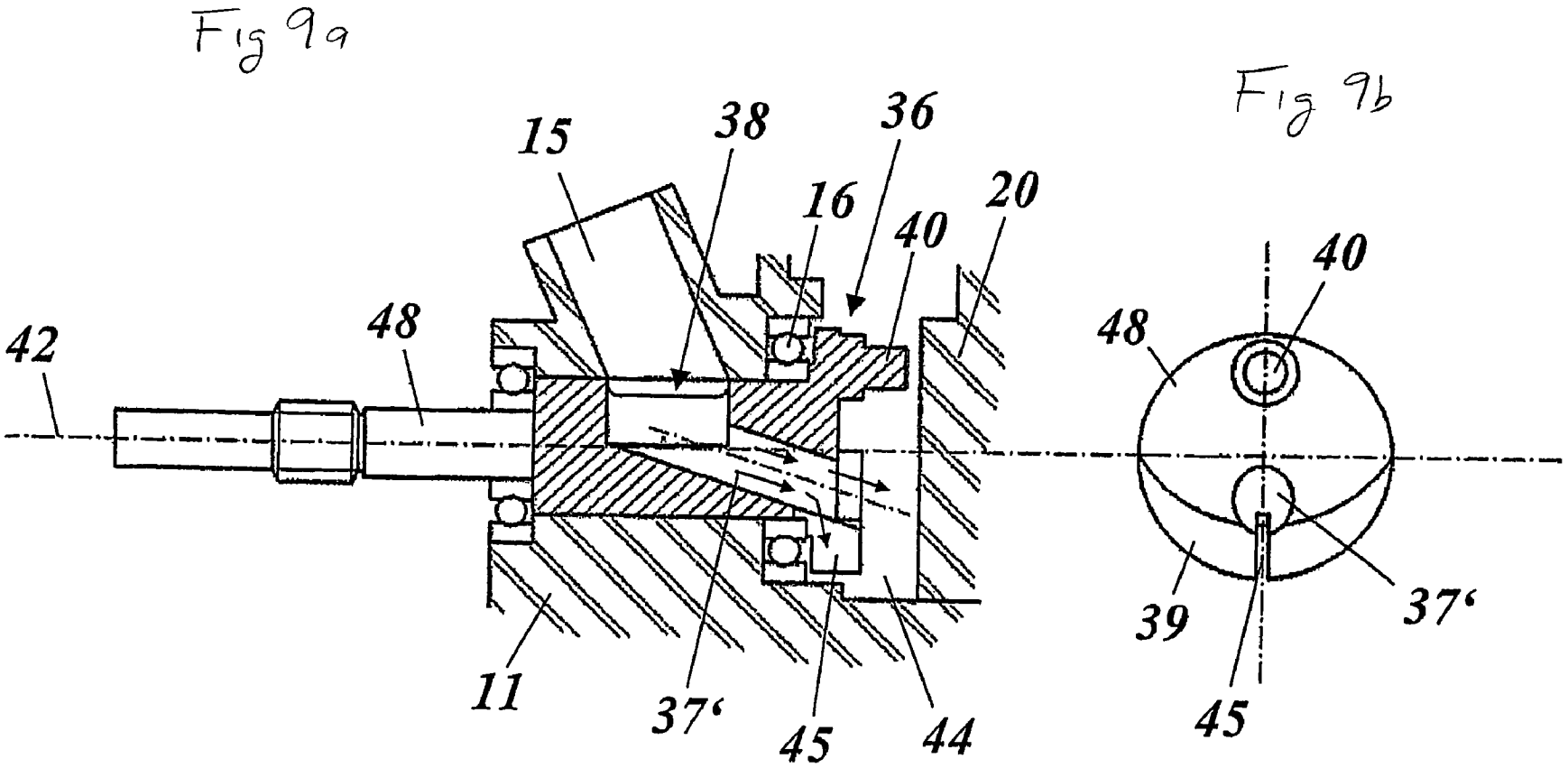
FIGS. 9*a* and 9*b* show, in illustrations similar to FIGS. 8*a* and 8*b,* a crankshaft with an oblique crankshaft duct as per FIG. 7 and an additional radial opening as per FIGS. 8*a* and 8*b;*

A further embodiment of the influence according to the invention exerted on the mixture flow in the crankcase is illustrated in FIGS. 8*a* and 8*b*. Here, at the end of the coaxial crankshaft duct 37, a radial slot 45 is formed (transverse through the counterweight 39) at that side of the disk-shaped section 36 which is situated opposite from the crank pin 40, which slot 45 extends axially into the crankshaft 18 to such an extent that the bearing 16 situated behind the section 36 comes into direct contact with the mixture from the crankshaft duct 37. As is generally known, a two-stroke engine is lubricated only by the oil contained in the fuel. For this reason, it is important to conduct the oil-containing air/fuel mixture to the ball bearing 16 or to a similar plain bearing. As a result of the centrifugal force generated by the fast rotation of the crankshaft 18, mixture is conveyed from the crankshaft duct 37, radially through the slot, to the bearing 16. At the same time, the mixture—as already described further above—is centrifuged into at least one of the laterally arranged transfer ducts 32*a*-32*c* and the transfer of the mixture from the crank space 44 into the working or combustion space is thereby accelerated. Said two effects of the slot 45 can, as per FIGS. 9*a* and 9*b*, also be combined with the pumping effect of an obliquely-running crankshaft duct 37' in order to thereby obtain further improved filling with mixture while providing effective lubrication.

Figures 10A, 10B:
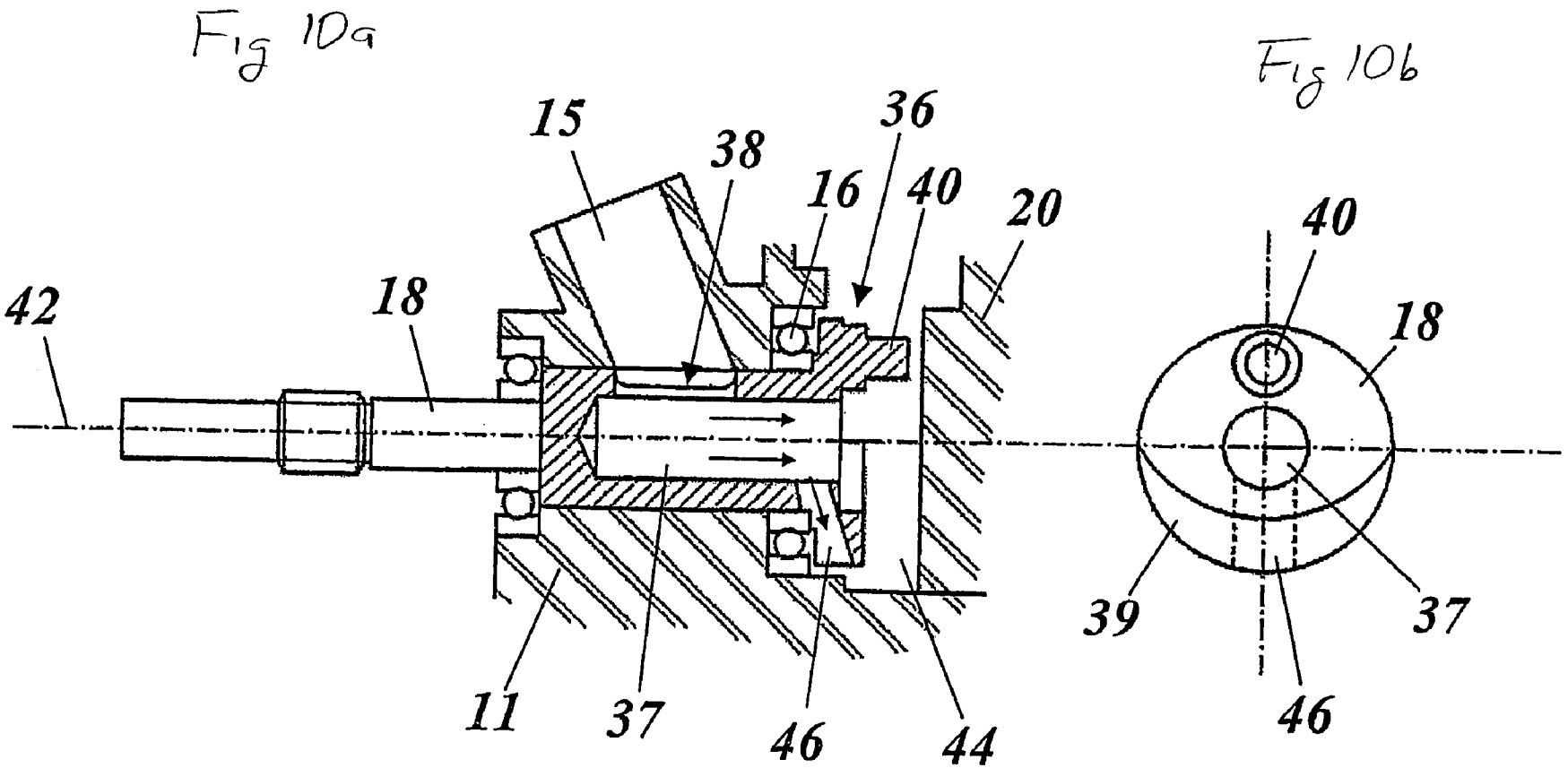
FIGS. 10*a* and 10*b* show, in an illustration similar to FIGS. 8*a* and 8*b,* a crankshaft as per a further exemplary embodiment with a duct instead of a slot.

FIGS. 10*a* and 10*b* show a further possibility within the context of the invention for improving the charging and at the same time ensuring the lubrication of the rear bearing 16 even at high rotational speeds. In this case, a radially running duct 46 is provided before the rear disk-shaped section 36 of the crankshaft 18, which radially running duct 46 proceeds from the crankshaft duct 37 and opens out in the region of the bearing 16 into the crank space 44. The duct 46 serves to conduct mixture directly to the bearing 16 for lubrication. In addition, on account of the centrifugal forces, the duct 46 centrifuges mixture into one of the laterally arranged transfer ducts 32*a*-32*c*.

Figure 12A:
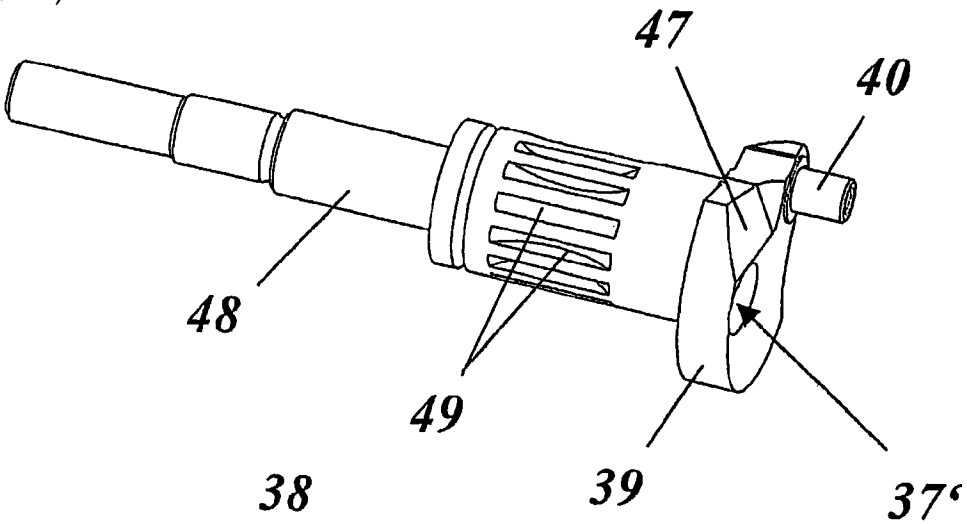
FIGS. 12*a*-12*d* show, in two perspective side views, in a longitudinal section and in cross section, respectively, an exemplary embodiment of a crankshaft with a beveled counterweight and chambers, arranged at the outer periphery, for improving the mixture transport.
Figure 12B:
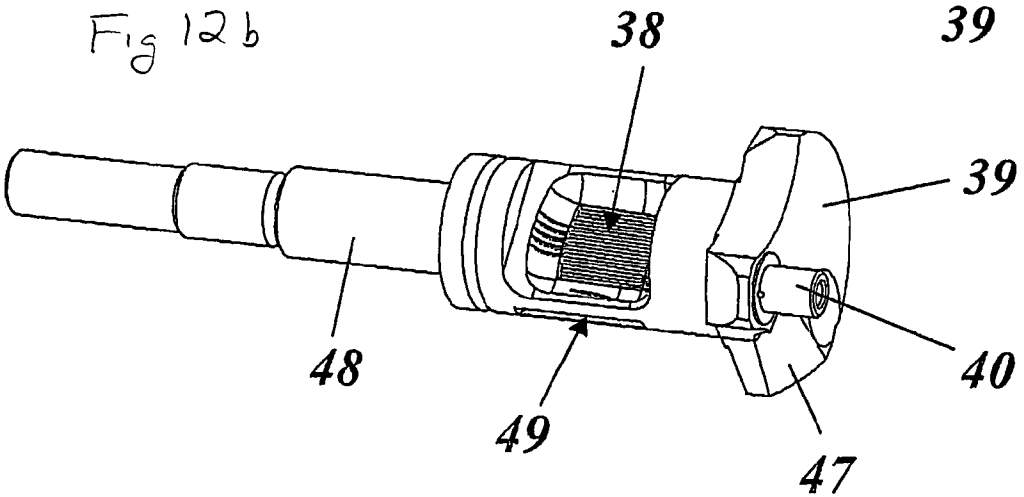
Figure 12C:
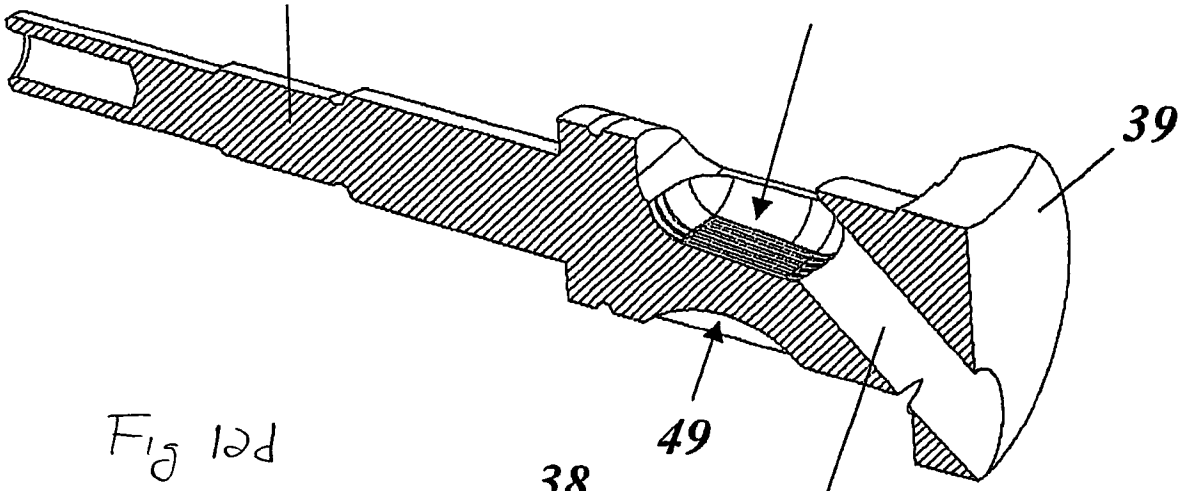
Figure 12D:
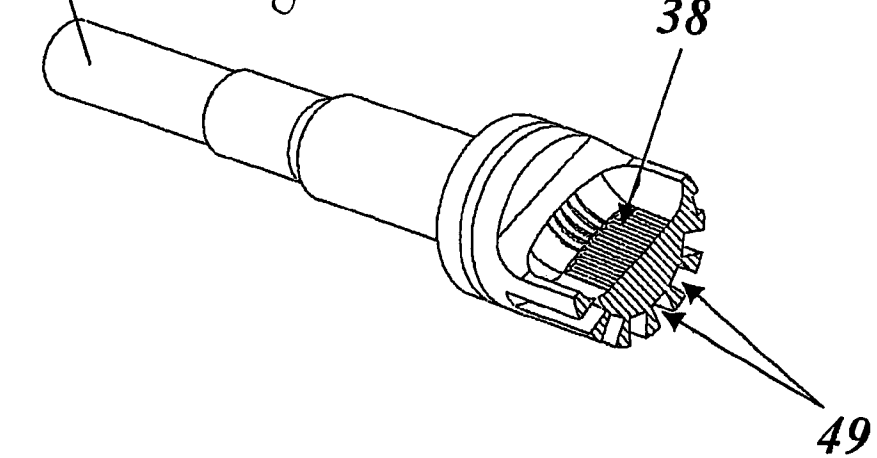

FIGS. 12*a* and 12*d* show a further possibility within the context of the invention for improving the charging in an exemplary embodiment, with FIGS. 12*a* and 12*b* showing different perspective side views, and with FIGS. 12*c* and 12*d* illustrating different section views. The exemplary embodiment of FIGS. 12*a*-12*d* show a crankshaft 48 with an inlet opening 38 and an obliquely-running crankshaft duct 37'. At the rear end of the crankshaft 48, the crank pin 40 is again arranged eccentrically and neutralized by a counterweight 39. The counterweight 39 is now provided with a beveled portion 47, that is to say for example is milled obliquely. As a result of the rotation of the crankshaft 48, gas mixture is conveyed rearward by means of the beveled portion 47 and causes a suction effect which sucks the new gas mixture from the crankshaft duct 37'. At the same time, the gas mixture is guided and accelerated into one or more of the transfer ducts 32*a*-32*c* which conduct the gas into the cylinder space.

Figure 13:
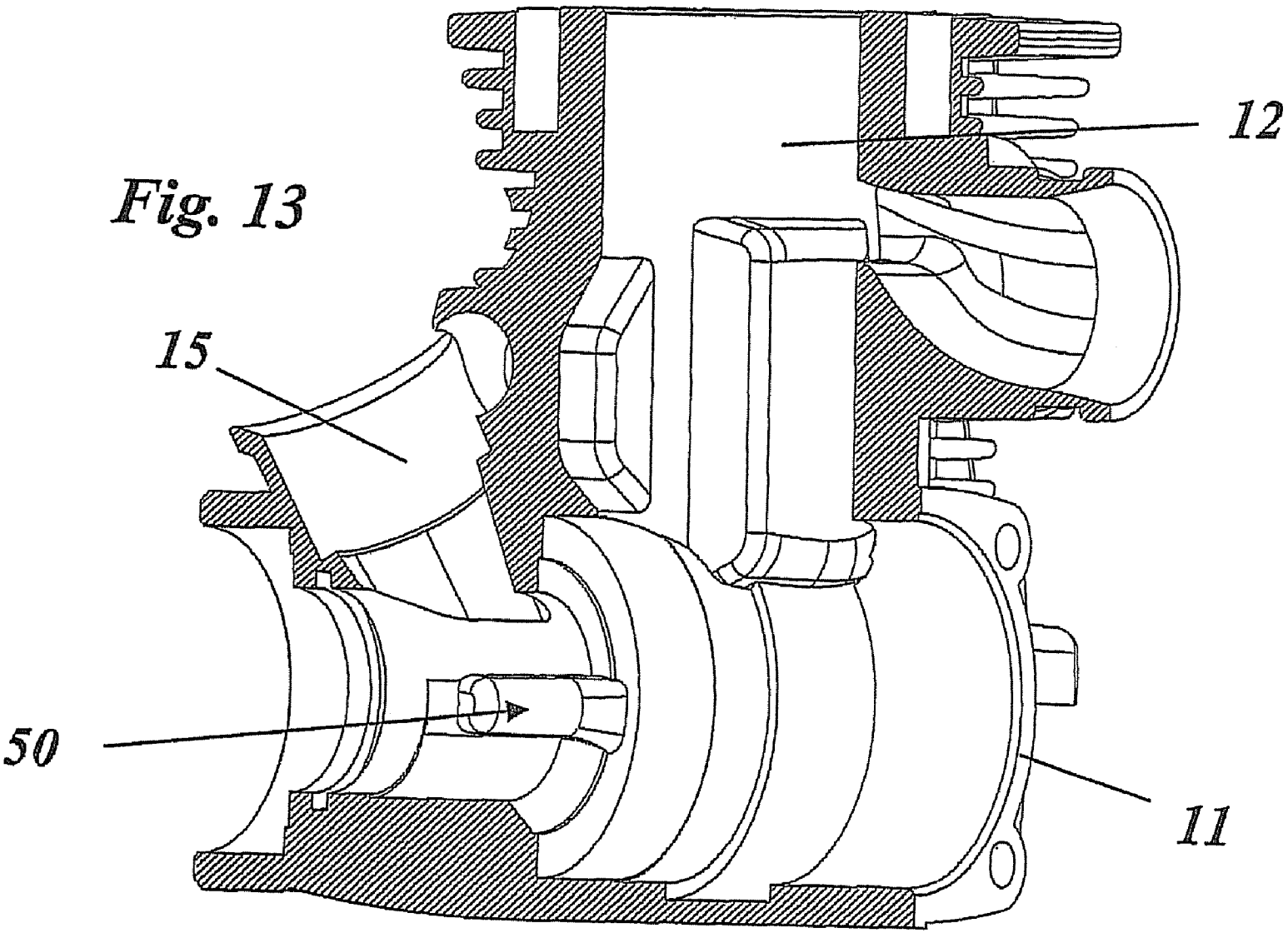
FIG. 13 shows, in longitudinal section, the associated crankcase having a throughflow duct which is formed in the case wall and interacts with the chambers of the crankshaft.
Figure 14:
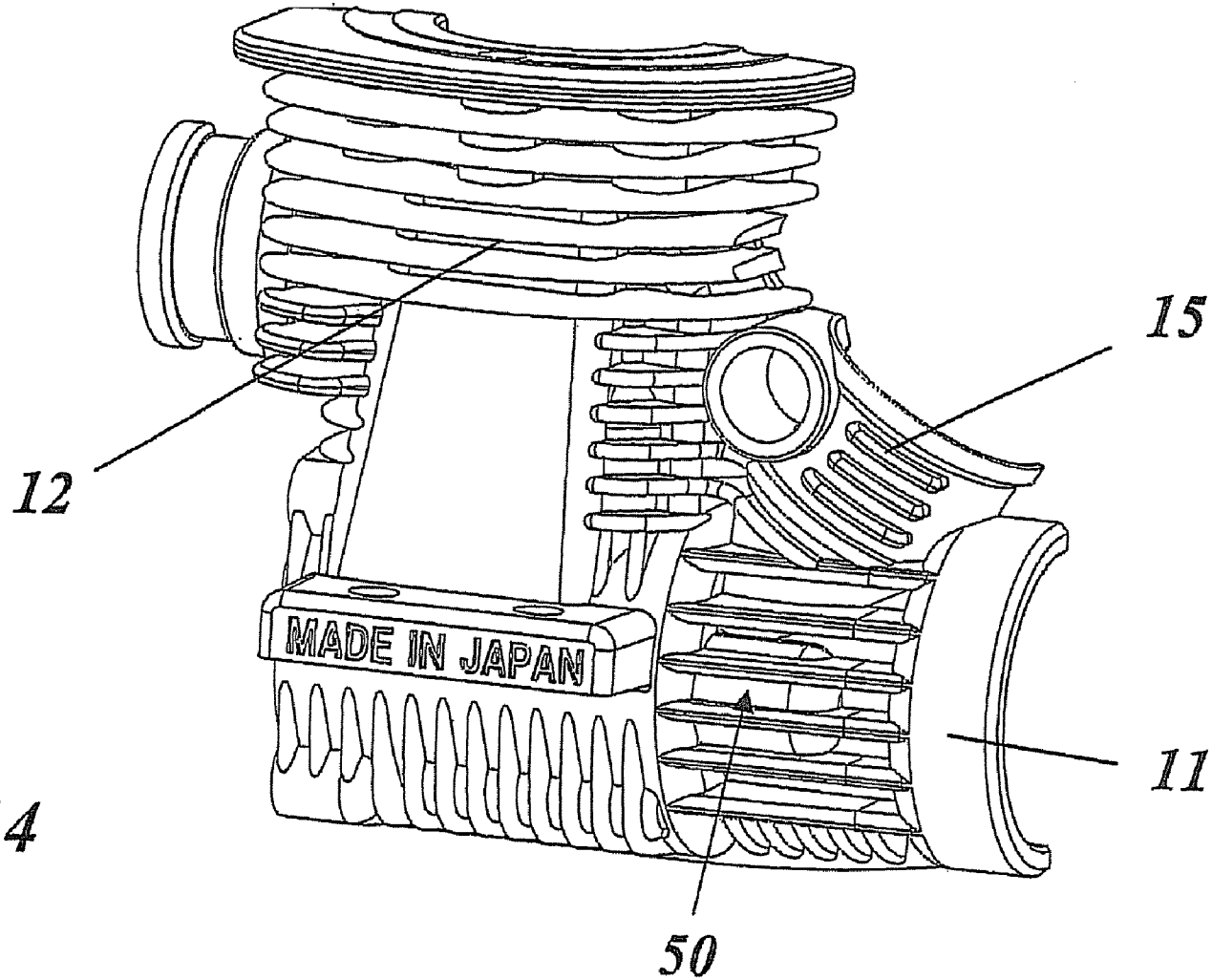
FIG. 14 shows the case of FIG. 13 in an external view with the throughflow duct.

A further improvement can be obtained using additional means which are illustrated in FIGS. 12*a*-14. Said additional means comprise chambers 49 (FIG. 12*a*) which are arranged in the crankshaft 48 and interact with a throughflow duct 50 which is formed in the wall of the crankcase 11 (FIGS. 13, 14). The desirably slot-shaped chambers 49, which extend in the axial direction, are arranged so as to be distributed over the periphery of the crankshaft 48, at the level of the inlet opening 38, outside the inlet opening. Air/fuel mixture situated in the chambers 49 can flow off via the likewise axial throughflow duct 50 into the rear space of the crankcase 11.

The intake of fresh gas mixture (mixture of air and fuel) is controlled by the inlet opening 38 in the crankshaft 48. When the intake opening 38 is open, air is sucked in via the carburetor. As a result of the venturi effect, fuel is also sucked in. Once the inlet opening has rotated beyond the intake pipe 15, the intake is blocked and the moving gas mixture rebounds back. The next time the inlet opening 38 opens, the air and the fuel must be set in motion again. This somewhat hinders the intake of the gas mixture.

The chambers 49 now accept the gas mixture, which is then guided by the action of the centrifugal force via the throughflow duct 50 into the rear case space. Here, the throughflow duct 50 is advantageously offset relative to the carburetor position (intake pipe 15) by approximately 90° in the rotational direction of the crankshaft. The gas mixture thereby advantageously flows through the ball bearing of the crankshaft 48 in order to lubricate and cool the ball bearing.

As a result, the rear case space is more effectively filled with gas mixture. This increases the torque and the power of the engine.

Overall, the invention is distinguished by the following properties and advantages:

The invention can be used without problems in existing engines by simply exchanging the crankshaft and/or the cover of the crankshaft case.

As a result of the improved guidance of the mixture flow, improved charging or filling of the engine and therefore a considerably higher level of power is obtained.

The pumping and/or centrifuging action, caused by the centrifugal force, of the oblique crankshaft duct and/or of the radial openings to the crank space accelerates the mixture as a function of the rotational speed and assists the suction action of the piston by means of a stand-alone pumping action.

Additional radial connections to the inner bearing of the crankshaft ensure the mixture lubrication of the bearing even at high rotational speeds.

The centrifuging and pumping action leads to an improved mixture of the air/fuel mixture and therefore to a higher level of power and reduced emissions.

The invention can be used to particular advantage in engines for model construction as well as in other applications in which there are in particular restrictions with regard to space and weight, such as for example in go-karts, motorized ultralight aircraft (ULM), micro air vehicles MAV or the like.

The invention claimed is:

1. A high-power two-stroke engine comprising:

a cylinder;

a piston which is mounted so as to be displaceable in the cylinder and delimits a working space;

a crankcase;

a crankshaft mounted in the crankcase so as to be rotatable about an axis, wherein the crankcase adjoins the cylinder and encloses a crank space which is connected to the cylinder, and an intake pipe for an air/fuel mixture being formed on the crankcase, wherein:

the piston is connected via a connecting rod to the crankshaft;

in the crankshaft runs a crankshaft duct in the longitudinal direction which opens out into the crank space and is connected, as a function of the rotational angle of the crankshaft, by means of an inlet opening to the intake pipe;

at least one transfer duct is formed in the cylinder, by means of which transfer duct the air/fuel mixture can, as a function of the position of the piston in the cylinder, flow from the crank space past the piston and into the working space;

deflector elements are arranged within the crankcase and are adapted to fill the crank space with the air/fuel mixture;

the deflector elements comprise a crankshaft duct which runs within the crankshaft in such a way that the centrifugal forces which occur as the crankshaft rotates accelerate the air/fuel mixture flowing in the crankshaft duct in the direction of the crank space;

the crankshaft duct is formed as a bore and encloses an angle $\alpha>0°$ with the axis of the crankshaft;

the connecting rod is connected to the crankshaft by means of an eccentrically arranged crank pin, and the crankshaft duct opens out into the crank space at the side opposite from the crank pin;

a slot which runs in the radial direction between the crankshaft duct and the crank space is provided in the crankshaft; and the slot is arranged at the side opposite from the crank pin.

2. The high-power two-stroke engine as claimed in claim 1, wherein the crankshaft duct runs within the crankshaft in such a way that the spacing between the axis of the crankshaft duct and the axis of the crankshaft increases with reducing distance to the crank space.

3. A high-power two-stroke engine comprising:

a cylinder;

a piston which is mounted so as to be displaceable in the cylinder and delimits a working space;

a crankcase;

a crankshaft mounted in the crankcase so as to be rotatable about an axis, wherein the crankcase adjoins the cylinder and encloses a crank space which is connected to the cylinder, and an intake pipe for an air/fuel mixture being formed on the crankcase, wherein:

the piston is connected via a connecting rod to the crankshaft;

in the crankshaft runs a crankshaft duct in the longitudinal direction which opens out into the crank space and is connected, as a function of the rotational angle of the crankshaft, by means of an inlet opening to the intake pipe;

at least one transfer duct is formed in the cylinder, by means of which transfer duct the air/fuel mixture can, as a function of the position of the piston in the cylinder, flow from the crank space past the piston and into the working space;

deflector elements are arranged within the crankcase and are adapted to fill the crank space with the air/fuel mixture;

the deflector elements comprise a crankshaft duct which runs within the crankshaft in such a way that the centrifugal forces which occur as the crankshaft rotates accelerate the air/fuel mixture flowing in the crankshaft duct in the direction of the crank space;

the crankshaft duct is formed as a bore and encloses an angle $\alpha>0°$ with the axis of the crankshaft;

the connecting rod is connected to the crankshaft by means of an eccentrically arranged crank pin, and the crankshaft duct opens out into the crank space at the side opposite from the crank pin;

a slot which runs in the radial direction between the crankshaft duct and the crank space is provided in the crankshaft; and the crankshaft has, in the region of the crank space, a disk-shaped section which is perpendicular to the axis and to which the crank pin is fastened, the crankshaft is rotatably mounted, at that side of the disk-shaped section which faces away from the crank space, in a bearing, the slot is arranged in the disk-shaped section, and the slot is formed such that air/fuel mixture situated in the crankshaft duct passes through the slot directly to the bearing.

4. The high-power two-stroke engine as claimed in claim 3, wherein the slot is arranged at the side opposite from the crank pin.

5. A high-power two-stroke engine comprising:

a cylinder;

a piston which is mounted so as to be displaceable in the cylinder and delimits a working space;

a crankcase;

a crankshaft mounted in the crankcase so as to be rotatable about an axis, wherein the crankcase adjoins the cylinder and encloses a crank space which is connected to the cylinder, and an intake pipe for an air/fuel mixture being formed on the crankcase, wherein:

the piston is connected via a connecting rod to the crankshaft;

in the crankshaft runs a crankshaft duct in the longitudinal direction which opens out into the crank space and is connected, as a function of the rotational angle of the crankshaft, by means of an inlet opening to the intake pipe;

at least one transfer duct is formed in the cylinder, by means of which transfer duct the air/fuel mixture can, as a function of the position of the piston in the cylinder, flow from the crank space past the piston and into the working space;

deflector elements are arranged within the crankcase and are adapted to fill the crank space with the air/fuel mixture;

the deflector elements comprise a slot which runs in the crankshaft in the radial direction between the crankshaft duct and the crank space;

the connecting rod is connected to the crankshaft by means of an eccentrically arranged crank pin, and the slot is arranged at the side opposite from the crank pin; and the crankshaft has, in the region of the crank space, a disk-shaped section which is perpendicular to the axis and to which the crank pin is fastened, the crankshaft is rotatably mounted, at that side of the disk-shaped section which faces away from the crank space, in a bearing, the slot is arranged at least partially in the disk-shaped section, and the slot is formed such that air/fuel mixture situated in the crankshaft duct passes through the slot directly to the bearing.

6. A high-power two-stroke engine comprising:

a cylinder;

a piston which is mounted so as to be displaceable in the cylinder and delimits a working space;

a crankcase;

a crankshaft mounted in the crankcase so as to be rotatable about an axis, wherein the crankcase adjoins the cylinder and encloses a crank space which is connected to the cylinder, and an intake pipe for an air/fuel mixture being formed on the crankcase, wherein:

the piston is connected via a connecting rod to the crankshaft;

in the crankshaft runs a crankshaft duct in the longitudinal direction which opens out into the crank space and is connected, as a function of the rotational angle of the crankshaft, by means of an inlet opening to the intake pipe;

at least one transfer duct is formed in the cylinder, by means of which transfer duct the air/fuel mixture can, as a function of the position of the piston in the cylinder, flow from the crank space past the piston and into the working space;

deflector elements are arranged within the crankcase and are adapted to fill the crank space with the air/fuel mixture; and the deflector elements comprise a slot which runs in the crankshaft in the radial direction between the crankshaft duct and the crank space.

7. A high-power two-stroke engine comprising:

a cylinder;

a piston which is mounted so as to be displaceable in the cylinder and delimits a working space;

a crankcase;

a crankshaft mounted in the crankcase so as to be rotatable about an axis, wherein the crankcase adjoins the cylinder and encloses a crank space which is connected to the cylinder, and an intake pipe for an air/fuel mixture being formed on the crankcase, wherein:

the piston is connected via a connecting rod to the crankshaft;

in the crankshaft runs a crankshaft duct in the longitudinal direction which opens out into the crank space and is connected, as a function of the rotational angle of the crankshaft, by means of an inlet opening to the intake pipe;

at least one transfer duct is formed in the cylinder, by means of which transfer duct the air/fuel mixture can, as a function of the position of the piston in the cylinder, flow from the crank space past the piston and into the working space;

deflector elements are arranged within the crankcase and are adapted to fill the crank space with the air/fuel mixture;

the crank space is delimited, at the side opposite from the aperture of the crankshaft duct, by a wall which is aligned perpendicular to the crankshaft duct, and the deflector elements are formed as deflecting means arranged in the wall and deflect the flow of air/fuel mixture, which passes out of the crankshaft duct and impinges perpendicularly on the wall, to the side; and the deflecting means comprise a deflecting cone.

8. A high-power two-stroke engine comprising:

a cylinder;

a piston which is mounted so as to be displaceable in the cylinder and delimits a working space;

a crankcase;

a crankshaft mounted in the crankcase so as to be rotatable about an axis, wherein the crankcase adjoins the cylinder and encloses a crank space which is connected to the cylinder, and an intake pipe for an air/fuel mixture being formed on the crankcase, wherein:

the piston is connected via a connecting rod to the crankshaft;

in the crankshaft runs a crankshaft duct in the longitudinal direction which opens out into the crank space and is connected, as a function of the rotational angle of the crankshaft, by means of an inlet opening to the intake pipe;

at least one transfer duct is formed in the cylinder, by means of which transfer duct the air/fuel mixture can, as a function of the position of the piston in the cylinder, flow from the crank space past the piston and into the working space;

deflector elements are arranged within the crankcase and are adapted to fill the crank space with the air/fuel mixture;

the crankshaft has a counterweight; and the deflector elements comprise a beveled portion which is formed on the counterweight in such a way that the air/fuel mixture is conveyed rearward as the crankshaft rotates.

9. A high-power two-stroke engine comprising:

a cylinder;

a piston which is mounted so as to be displaceable in the cylinder and delimits a working space;

a crankcase;

a crankshaft mounted in the crankcase so as to be rotatable about an axis, wherein the crankcase adjoins the cylinder and encloses a crank space which is connected to the cylinder, and an intake pipe for an air/fuel mixture being formed on the crankcase, wherein:

the piston is connected via a connecting rod to the crankshaft;

in the crankshaft runs a crankshaft duct in the longitudinal direction which opens out into the crank space and is connected, as a function of the rotational angle of the crankshaft, by means of an inlet opening to the intake pipe;

at least one transfer duct is formed in the cylinder, by means of which transfer duct the air/fuel mixture can, as a function of the position of the piston in the cylinder, flow from the crank space past the piston and into the working space;

deflector elements are arranged within the crankcase and are adapted to fill the crank space with the air/fuel mixture;

the deflector elements include a plurality of slot-shaped chambers which extend in the axial direction and are arranged, at the level of the inlet opening, outside the inlet opening so as to be distributed over the periphery of the crankshaft; and an axial throughflow duct, which interacts with the chambers, is provided in the crankcase, via which throughflow duct air/fuel mixture situated in the chambers can flow off into the rear space of the crankcase.

10. The high-power two-stroke engine as claimed in claim 9, wherein the throughflow duct is arranged so as to be offset relative to the intake pipe by approximately 90° in the rotational direction of the crankshaft.

* * * * *